US006349625B1

(12) United States Patent
Poganski

(10) Patent No.: US 6,349,625 B1
(45) Date of Patent: Feb. 26, 2002

(54) TOOL SOCKET

(75) Inventor: Joel Poganski, W. Milford, NJ (US)

(73) Assignee: Unex Corporation, Mahwah, NJ (US)

( * ) Notice: Subject to any disclaimer, the term of this patent is extended or adjusted under 35 U.S.C. 154(b) by 0 days.

(21) Appl. No.: 09/614,803

(22) Filed: Jul. 12, 2000

(51) Int. Cl.[7] ..... B25B 23/157
(52) U.S. Cl. ..... 81/475; 81/473
(58) Field of Search ..... 81/473–476

(56) References Cited

U.S. PATENT DOCUMENTS 3,662,628 A * 5/1972 Schnepel ..... 81/474
3,876,369 A * 4/1975 Behrens ..... 81/475
4,964,319 A * 10/1990 Chang ..... 81/58.3
5,813,298 A * 9/1998 Beattie ..... 81/475

FOREIGN PATENT DOCUMENTS

GB 2 062 524 A * 5/1972 ..... 81/475

* cited by examiner

*Primary Examiner*—Joseph J. Hail, III
*Assistant Examiner*—David B Thomas
(74) *Attorney, Agent, or Firm*—Micheal J. Striker

(57) ABSTRACT

A tool socket has a tool-associated element provided with first connecting means formed to connect the first tool-associated element with a tool, a second fastener-associated element provided with second connecting means for connecting the second fastener-associated element with a fastener to be tightened and loosened, the tool-associated element and the fastener-associated element having faces directed toward one another, an engaging element for engaging the first tool-associated element and the second fastener-associated element with one another and including gear teeth provided on the faces of the tool-associated element and the fastener-associated element, and a holding element operative for holding the tool-associated element and the fastener-associated element in engagement with one another and having a holding force limit such that when a resistance of a fastener exceeds a predetermined value the first and second elements disengage from one another and the first tool-associated element continues turning while said second fastener-associated element remain stationary.

9 Claims, 1 Drawing Sheet

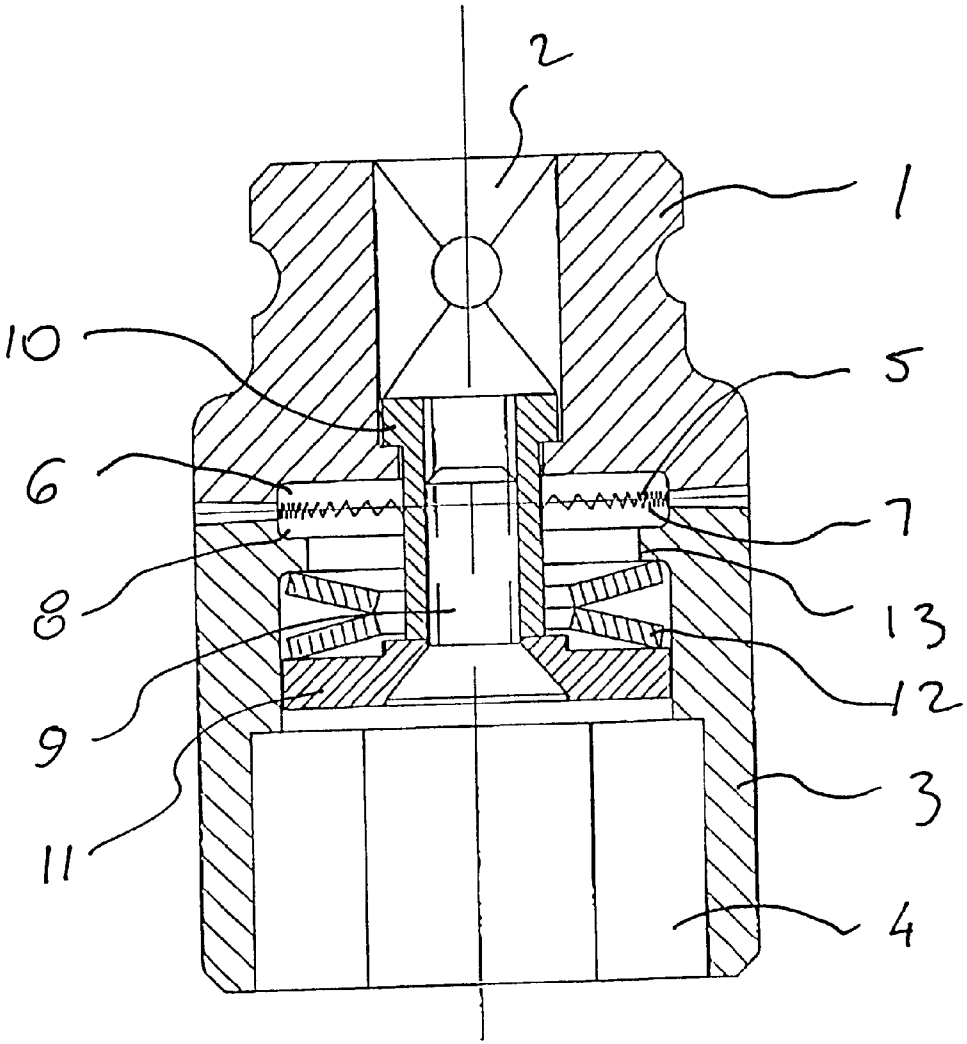
1
2
5
7
13
12
3
4
10
6
8
9
11

TOOL SOCKET

BACKGROUND OF THE INVENTION

The present invention relates to tool sockets, and in particular to tool sockets preferably for impact wrenches.

In the industry impact wrenches are still very popular and especially for the smaller nut sizes. However, impact wrenches are extremely inaccurate when it goes to torque repeatability or torque accuracy. Therefore, in many cases, the fastener for example a nut is impacted down and then tightened to torque with a torque wrench. This is inconvenient, since it takes more time and requires the use of two tools for one job.

It is known to provide corresponding mechanisms which are built in the drive portion of power tools. This means however the disadvantage that the tools multiple and repeated use weakens the mechanism so that it becomes unreliable. In addition, since the drive portion of the power tool is usually contained in a housing, the gear teeth of such a mechanism require frequent replacement due to the limited square inch engagement possibilities.

SUMMARY OF THE INVENTION

Accordingly, it is an object of present invention to provide a tool socket of the above mentioned general type which avoids the disadvantages of the prior art.

In keeping with these objects and with others which will become apparent hereinafter, one feature of present invention resides, briefly stated, in a tool socket which has a tool-associated element provided with first connecting means formed to connect the first tool-associated element with a tool to be turned by the tool, a second fastener-associated element provided with second connecting means for connecting the second fastener-associated element with a fastener to be tightened and loosened, the tool-associated element and the fastener-associated element having faces directed toward one another; engaging means for engaging the first tool-associated element and the second fastener-associated element with one another so that when said first tool-associated element is turned by the tool it turns said second fastener-associated element, said engaging means including gear teeth provided on the faces of the tool-associated element and the fastener-associated element; and holding means operative for holding the engaging means and therefore the tool-associated element and the fastener-associated element in engagement with one another and having a holding force limit such that when a resistance of a fastener exceeds a predetermined value said first and second elements disengage from one another and said first tool-associated element continues turning while said second fastener-associated element remain stationary.

The tool socket in accordance with the present invention provides the highly advantageous results, since it is composed of two elements which are connected with one another engageably and disengageable under certain conditions of operation. This is principally new and contradicts the long standing approach in the industry which has been maintained for decades. Usually tool sockets are very rigid, high strength, integral elements which have to transmit tremendous torques to the fasteners. The present invention departed from the long established prejudice and provides a new tool socket which is unobvious and highly advantageous.

With the present invention each socket can be used for one nut size only, and even if the hex inserts are being used, it is limited to a maximum 3 hex or 12-point sizes due to radial application problems resulted from the size reduction. Therefore, a given tool socket size is used much less frequently than the power tool that turns it. Since the gear teeth are located on the circumference of the inner walls of the tool socket and their depth is equivalent to the wall thickness of the socket, the square inch displacement is drastically improved. A further important advantage is that the invention becomes more accurate simply because unlike a drive of a power tool which is subject to torsion and subject to a drive engagement with a prior art socket, the tool socket of this invention is directly connected with the nut to be turned. A further advantage over the prior art is that a tool with such a tool socket can be manufactured relatively simply, thus reducing the cost over other torque-controlled tools.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a new tool socket in accordance with the present invention.

DESCRIPTION OF PREFERRED EMBODIMENTS

A tool socket in accordance with the present invention has a first tool-associated socket element which is identified with reference numeral 1. The socket element 1 has means for connecting to a power tool formed for example as a polygonal opening 2. The tool socket in accordance with the present invention has a second fastener-associated socket element which is identified with reference numeral 3. The socket element 3 is provided with means for engaging a fastener, such as a nut and the like and formed for example as a polygonal opening 4.

The inventive tool socket further has engaging means which provide engagement of the socket element 1 with a socket element 3. The engaging means include a first set of teeth 5 provided on a lower face of a peripheral wall of the socket element 1 which surrounds a central opening 6 of the socket element 1, and another set of teeth 7 provided on an upper face of a peripheral wall of the socket element 3 which surrounds a central opening 8 of the socket element 3. The teeth 5 and 7 are engageable with one another.

The engaging teeth 5 and 7 are held in engagement with one another and thereby the socket elements 1 and 3 are held together by holding means. The holding means include a central pin 9 which has a threaded shaft screwed in a bushing 10. The bushing 10 has a flange which is seated on a shoulder of the opening 2 of the socket element 1. The head of the pin 9 is seated in a conical opening of a disk 11 which is accommodated in a further opening communicating with the polygonal opening 4 of the socket element 3. Spring means 12 is further provided and can be formed for example as a set of two plate springs. The spring means 12 is located between the disk 11 and a shoulder 13 formed in the socket element 3. The spring means 12 urges the socket element 3 toward the socket element 1 and thereby urges the teeth 7 into engagement with the teeth 5. The spring means 12 has a predetermined force with which it acts on the socket element 3 to keep it in engagement with the socket element 1.

The tool socket in accordance with the present invention with the present invention operates in the following manner. When a not shown power tool is connected to the socket element 1 and turns the socket element 1 with a given force, the given force is transmitted to the socket element 3 and thereby to a not shown fastener engaged by the socket element 3. When the force applied by the tool increases and exceeds the above mentioned given force, a resistence of the fastener exceeds a preset compression force of the spring means, the teeth 5 and 7 disengage from one another, and only the socket element 1 is turning while the socket element 3 remains stationary.

In the inventive tool socket the force which holds the socket elements 1 and 3 in engagement or in other words a compression force of the spring means 12 can be regulated, by screwing the pin 9 more or less into the bushing 10 which is held in the socket element 1. Also, the gears 5 and 7 can be locked with one another and thereby the socket elements 1 and 3 can be disengagably connected with one another. This can be done by screwing the nut 9 into the bushing 10 so that the spring means 12 is completely compressed.

It will be understood that each of the elements described above, or two or more together, may also find a useful application in other types of constructions differing from the types described above.

While the invention has been illustrated and described as embodied in tool socket, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A tool socket, comprising a tool-associated element provided with first connecting means formed to connect said first tool-associated element directly with a tool to be turned by the tool; a second fastener-associated element provided with second connecting means for connecting said second fastener-associated element directly with a fastener to be tightened and loosened; said tool-associated element and said fastener-associated element having faces directed toward one another; engaging means for engaging said first tool-associated element and said second fastener-associated element directly with one another so that when said first tool-associated element is turned directly by the tool it turns said second fastener-associated element and said fastener-associated element directly turns the fastener, holding means operative for holding said engaging means and therefore said tool-associated element and said fastener-associated element in engagement with one another and having a holding force limit such that when a resistance of a fastener exceeds a predetermined value said first and second elements disengage from one another and said first tool-associated element continues turning while said second fastener-associated element remains stationary.

2. A tool socket as defined in claim 1, wherein said holding means include a pin-shaped element connecting said first tool-associated element with said second fastener-associated element; and spring means which spring biases said first and second elements toward one another and provides said holding force.

3. A tool socket as defined in claim 1; and further comprising means for regulating said holding force.

4. A tool socket as defined in claim 3; wherein said regulating means is formed so as to change a compression of said spring means.

5. A tool socket as defined in claim 1; and further comprising means for locking said tool-associated element within said fastener-associated element so that they can not disengage from one another.

6. A tool socket as defined in claim 5; and further comprising spring means which spring bias said first and second elements toward one another, said locking means being formed so as to completely compress said spring means.

7. A tool socket as defined in claim 1, wherein said faces of said tool-associated portion and said fastener-associated portion have openings substantially corresponding to one another, said gear teeth are being formed as peripheral teeth provided on peripheral walls of said openings.

8. A tool socket, consisting of a tool-associated element provided with first connecting means formed to connect said first tool-associated element directly with a tool to be turned by the tool; a second fastener-associated element provided with second connecting means for connecting said second fastener-associated element directly with a fastener to be tightened and loosened; said tool-associated element and said fastener-associated element having faces directed toward one another; engaging means for engaging said first tool-associated element and said second fastener-associated element directly with one another so that when said first tool-associated element is turned directly by the tool it turns said second fastener-associated element and said fastener-associated element directly turns the fastener; holding means operative for holding said engaging means and therefore said tool-associated element and said fastener-associated element in engagement with one another and having a holding force limit such that when a resistance of a fastener exceeds a predetermined value said first and second elements disengage from one another and said first tool-associated element continues turning while said second fastener-associated element remains stationary.

9. A tool socket, comprising a tool-associated element provided with first connecting means formed to connect said first tool-associated element with a tool to be turned by the tool; a second fastener-associated element provided with second connecting means for connecting said second fastener-associated element with a fastener to be tightened and loosened; said tool-associated element and said fastener-associated element having faces directed toward one another; engaging means for engaging said first tool-associated element and said second fastener-associated element with one another so that when said first tool-associated element is turned by the tool it turns said second fastener-associated element, said engaging means including gear teeth provided on said faces of said tool-associated element and said fastener-associated element; and holding means operative for holding said engaging means and therefore said tool-associated element and said fastener-associated element in engagement with one another and having a holding force limit such that when a resistance of a fastener exceeds a predetermined value said first and second elements disengage from one another and said first tool-associated element continues turning while said second fastener-associated element remains stationary; spring means for urging said tool-associated element and said fastener-associated element toward one another; and means for regulating said holding force, said regulating means including a bushing associated with one of said elements and a pin associated with the other of said elements, said pin being screwable into said bushing more or less so as to change a compression force of said spring means and thereby to regulate said holding force.

* * * * *